US005183029A

United States Patent [19]

Ranger

[11] Patent Number: 5,183,029

[45] Date of Patent: Feb. 2, 1993

[54] HOT WATER SUPPLY SYSTEM

[76] Inventor: Gary C. Ranger, 44 Cotton Avenue, Scarborough, Ontario, Canada, M1K 1Z4

[21] Appl. No.: 868,197

[22] Filed: Apr. 14, 1992

[51] Int. Cl.[5] ..... F24H 1/00

[52] U.S. Cl. ..... 126/362; 137/337; 237/59

[58] Field of Search ..... 126/362, 373, 374; 137/334, 337, 560; 237/59.8 R, 63

[56] References Cited

U.S. PATENT DOCUMENTS

| | | | |
|---|---|---|---|
| 489,971 | 1/1893 | Messier | 126/350 R |
| 1,583,342 | 5/1926 | Dlugosch | 126/362 |
| 1,779,165 | 10/1927 | Hallett | 122/12 |
| 2,399,985 | 5/1946 | Chandler | 126/362 |
| 2,515,885 | 7/1950 | Midyette, Jr. | 237/8 R |
| 2,823,695 | 2/1958 | Coffin | 137/337 |
| 2,915,080 | 12/1959 | Holmes | 137/337 |
| 3,111,942 | 11/1963 | Miller | 126/362 |
| 3,123,065 | 3/1964 | Conley | 126/362 |
| 4,248,378 | 2/1981 | Carruthers | 126/362 |

*Primary Examiner*—James C. Yeung

[57] ABSTRACT

In a domestic hot water supply system including at least one user terminal such as a shower head to which blended hot and cold water are supplied at a selected temperature, the cold water of the blend is supplied via a check valve which responds to changes in hydrodynamic pressure so as to regulate the volumetric flow of cold water and thereby compensate for changes of water demand in other parts of the system.

5 Claims, 3 Drawing Sheets

HOT WATER SUPPLY SYSTEM

This invention relates to hot water supply systems of the kind including a heating unit which receives cold water from a mains supply and is connected by a system of pipes to a variety of user terminals which also receive cold water from the mains supply. The invention is especially applicable to domestic water supply systems in which the user terminals typically include hot and cold water taps, shower heads, toilet fittings, washers and the like.

In the case of certain user terminals, such as shower heads, at which the water is delivered at a temperature determined by a blend of hot and cold water selected by the user, it is undesirable that the water temperature should be affected by changes in the water demand at other user terminals. It is an object of the present invention to provide a device by which changes in the water temperature at a given user terminal due to changes in the water demand at other terminals are largely reduced.

A hot water supply system according to the present invention comprises a heating unit having a cold water intake and a delivery outlet, a cold water supply pipe connected to the intake, a hot water delivery pipe connected to the outlet for delivering hot water to one or more user terminals, and a first branch pipe connected to the cold water supply pipe for delivering cold water to the user terminals. A further terminal, at which the water temperature is determined by a blend of hot and cold water selected by the user, is connected to the hot water delivery pipe by a second branch pipe, the latter being connected also to the cold water supply pipe by way of a check valve in shunt with the heating unit, the check valve being positioned to prevent the reverse flow of hot water into the cold water supply. This second branch pipe also includes a second check valve to prevent cold water from entering the hot water delivery pipe. In the system of the present invention, when the further user terminal is in use the first check valve responds to changes in water pressure so as to compensate for such changes and thereby maintain a substantially constant blend of hot and cold water delivered to said further user terminal independently of changes of water pressure in other parts of the system.

The first check valve and the second check valve may be flap gate valves or ball valves.

In order that the invention may be readily understood, two embodiments thereof will now be described by way of example with reference to the accompanying drawings.

In the drawings

Figure 1:
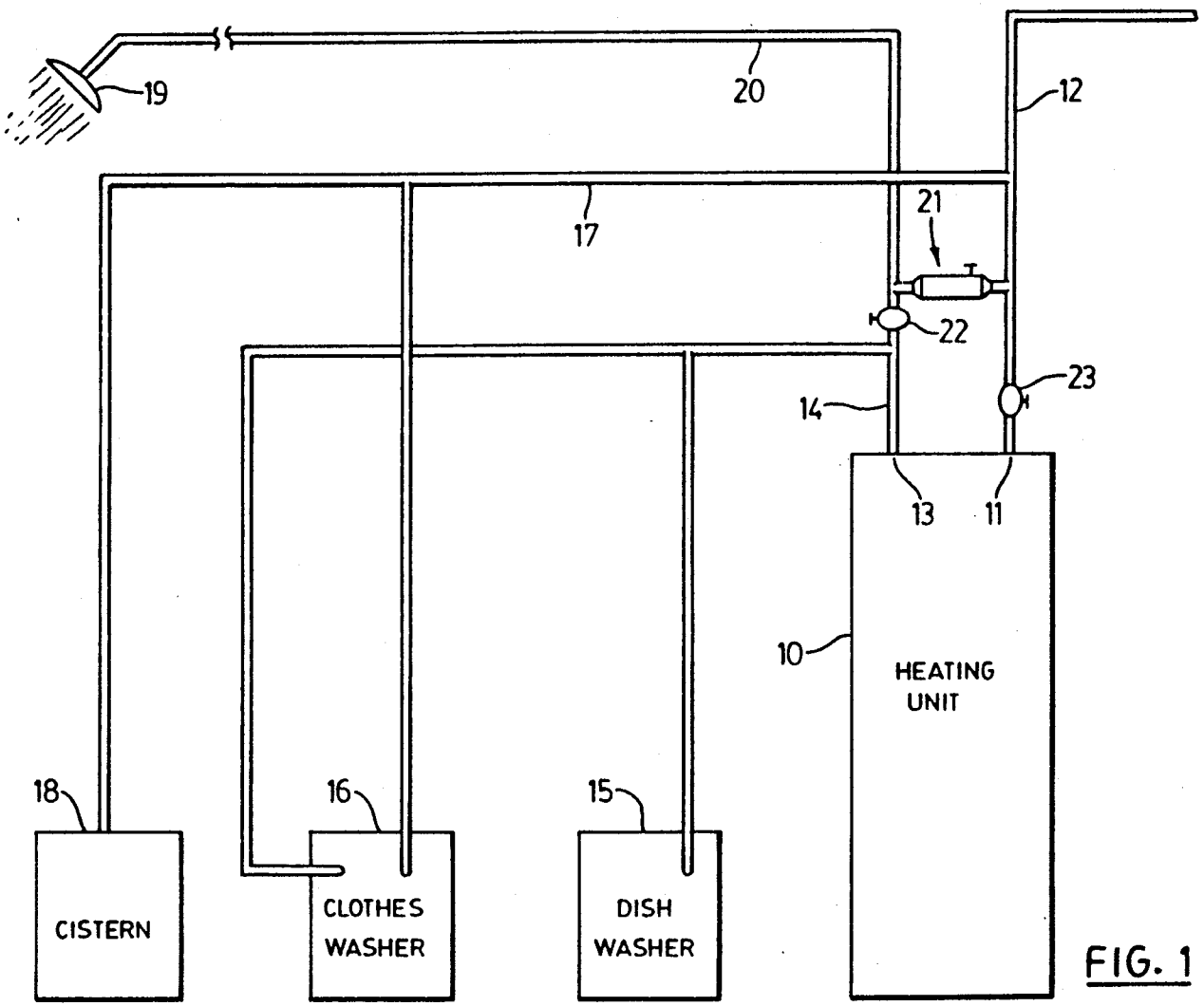
FIG. 1 is a partly diagrammatic illustration of a domestic hot water supply system according to the invention.

The hot water system shown in FIG. 1 comprises a heating unit 10 having a cold water intake 11 to which a mains cold water supply pipe 12 is connected, and a delivery outlet 13 to which a hot water delivery pipe 14 is connected for delivering hot water to one or more user terminals including a dish washer 15 and a clothes washer 16. Other user terminals to which hot water may be delivered by the delivery pipe 14 would include bath taps, wash basin taps etc., not shown. A branch pipe 17 from the cold water supply pipe 12 delivers cold water to a water cistern 18, and to the clothes washer 16 as well as various cold water taps of the other user terminals which are not shown in the drawing.

A further user terminal 19, which would typically be a shower head, receives a blend of hot and cold water via a branch pipe 20 of the hot water delivery pipe 14, the cold water of the blend being delivered via a valve unit 21 connected between the pipes 12 and 20 in shunt with the heater unit 10. The valve unit 21 includes a check valve (FIG. 2), which prevents the reverse flow of hot water into the cold water supply pipe 12. A second check valve 22 is connected in series with the branch pipe 20 on the upstream side of the latter's connection to the valve unit 21, the check valve 22 being positioned to prevent a reverse flow of cold water to the hot water delivery pipe 14. A conventional shut off valve 23 is provided in the cold water supply pipe 12 adjacent to its connection to the intake of the heating unit 10.

Although the drawings show only one user terminal 19 connected to the branch pipe 20, a number of such terminals may be connected to the branch pipe, the water temperature at those terminals being similarly controlled.

Figure 2:
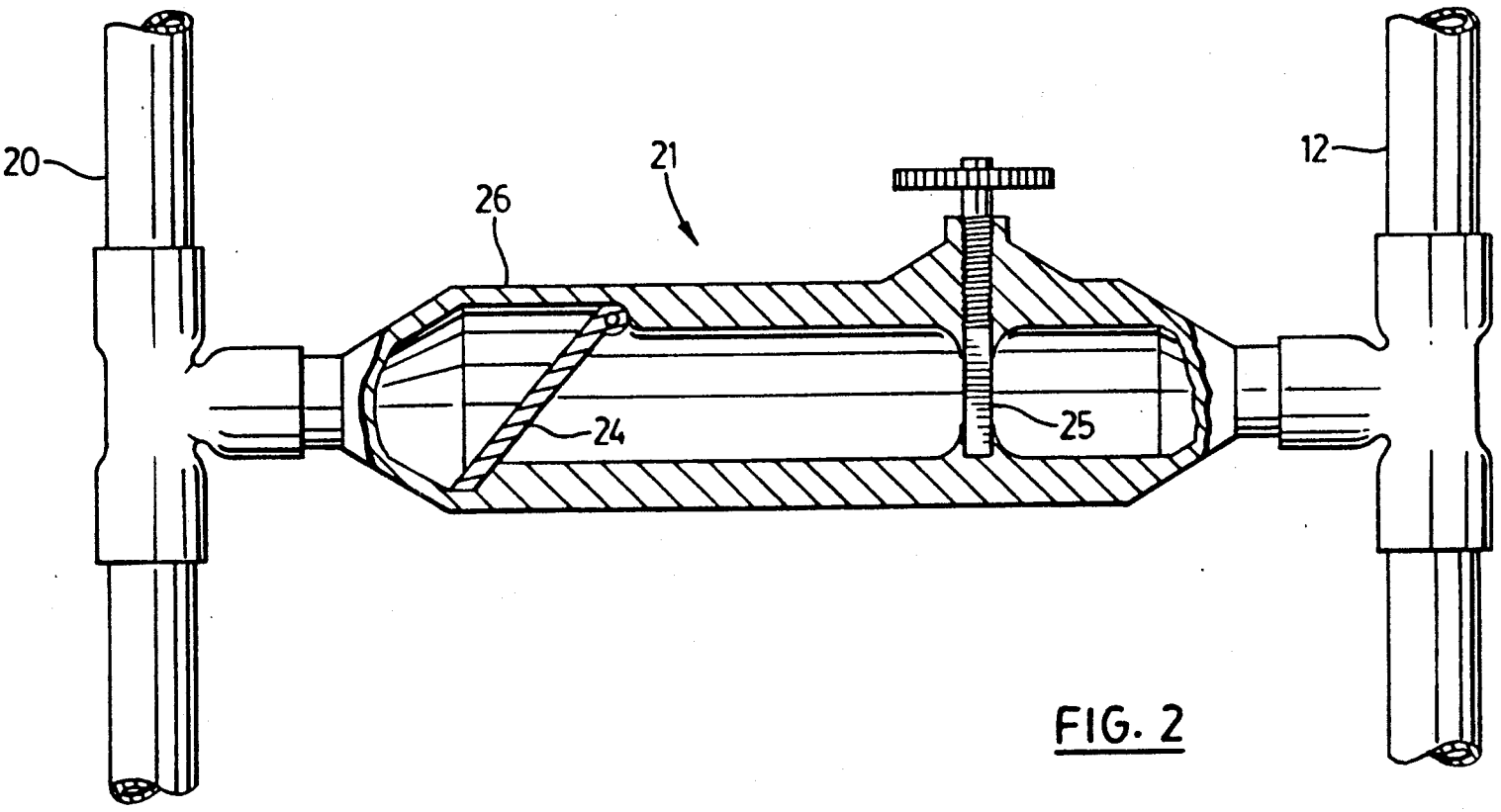
FIG. 2 is a sectional view of the bypass unit shown in FIG. 1.

FIG. 2 illustrates the valve unit 21 of FIG. 1 in more detail. The valve unit 21, as shown, comprises a flap gate valve 24 and a flow control valve 25 sharing a common tubular casing 26 connected at its ends to the pipes 12 and 20. However, these two valves may alternatively have individual casings. The flap gate valve 24 serves as a check valve to prevent the reverse flow of hot water into the cold water supply, as previously mentioned, and since the hinged flap member is exposed to water pressure on its opposite sides, it will respond to any change in the hydrodynamic pressure by opening or closing to adjust the cold water flow through the valve to compensate for such change. Thus, if while the user terminal 19 is in use the cold water flow through the valve is reduced due to an increased demand for cold water in another part of the system, the hydrodynamic pressure on the cold water side of the flap member will be increased, thus opening the flap member to a position at which the volumetric flow of cold water is increased thereby tending to restore the original blend of hot and cold water delivered to the shower head 19. Similarly, if the flow of cold water through the valve is suddenly increased, or if the supply of hot water through the branch pipe 20 is decreased, the change in the pressure differential across the valve 24 will cause the valve to restrict the flow of cold water and thereby tend to restore the original blend of hot and cold water delivered to the shower head.

The flow control valve of the bypass unit 21 is a manually adjustable gate valve 25 as shown, its purpose being to set the flow of cold water through the valve unit 21 to a desired value.

Figure 3:
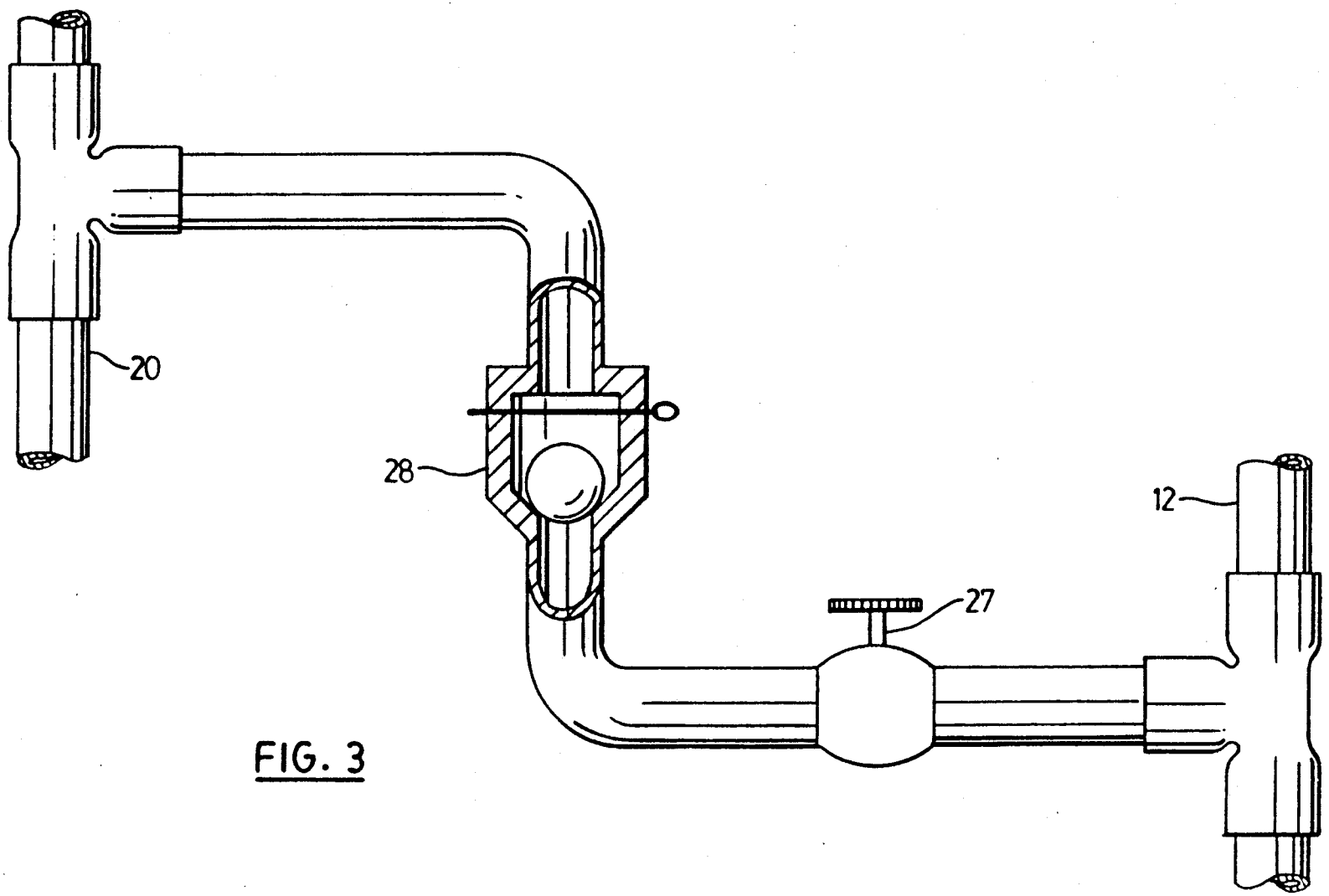
FIG. 3 is a sectional view of an alternative bypass unit which may be used in the system of FIG. 1.

FIG. 3 shows a detail of a modified system in which the check valve of the bypass unit 21 is a ball valve 28, other parts of the system being essentially as previously described. Since the ball valve 28 is exposed to the water pressure on its opposite sides, it similarly responds to any pressure changes due to an increased or decreased cold or hot water flow by taking up a position at which the original blend of hot and cold water supplied to the shower head is restored. The flow control valve of this embodiment, as in the embodiment of FIG. 2, is a manually adjustable gate valve 27 positioned in the bypass unit 21 between the check valve 28 and the cold water supply pipe 12.

I claim

1. A hot water supply system comprising a heating unit having a cold water intake and a delivery outlet, a cold water supply pipe connected to said intake, a hot water delivery pipe connected to said outlet for delivering hot water to one or more user terminals, a first branch pipe connected to the cold water supply pipe for delivering cold water directly to the user terminals, a second branch pipe connected to the hot water delivery pipe for delivering hot water to a further user terminal, characterized by means for maintaining the temperature of water supplied to said further user terminal substantially at a selected temperature independently of water demand at the other user terminals, said means comprising a bypass unit connected between the cold water supply pipe and said second branch pipe in shunt with the heating unit, said bypass unit including a first check valve positioned to prevent reverse flow of hot water into the cold water supply pipe, and a second check valve connected in said second branch pipe upstream of the connection to said bypass unit, the second check valve being positioned to prevent cold water flow from the bypass unit to said hot water delivery pipe, said first check valve being responsive to changes of hydrodynamic pressure differential across the valve so as to adjust the volumetric flow of cold water through the valve thereby to compensate for said changes.

2. A hot water supply system according to claim 1, wherein the first check valve is a flap gate valve.

3. A hot water supply system according to claim 1, wherein the first check valve is a ball valve.

4. A hot water supply system according to claim 1, wherein the bypass unit includes a flow control valve connected between said first check valve and the cold water supply pipe for controlling the flow of cold water via the bypass unit to said second branch pipe.

5. A cold water supply system according to claim 1, including a shut off valve connected in said cold water supply pipe downstream of the connection to the bypass unit.

* * * * *